US007699041B2

(12) United States Patent
Colletti et al.

(10) Patent No.: US 7,699,041 B2
(45) Date of Patent: Apr. 20, 2010

(54) FUEL DISTRIBUTION TUBE FOR DIRECT INJECTION FUEL RAIL ASSEMBLIES

(75) Inventors: Michael J. Colletti, Churchville, NY (US); Kristopher J. Duell, Brockport, NY (US); Donald Borraccia, Spenceport, NY (US)

(73) Assignee: Delphi Technologies, Inc., Troy, MI (US)

( * ) Notice: Subject to any disclaimer, the term of this patent is extended or adjusted under 35 U.S.C. 154(b) by 299 days.

(21) Appl. No.: 12/001,434

(22) Filed: Dec. 11, 2007

(65) Prior Publication Data

US 2009/0145504 A1 Jun. 11, 2009

(51) Int. Cl.
*F02M 69/46* (2006.01)

(52) U.S. Cl. ..... 123/456; 123/469; 285/288.11

(58) Field of Classification Search ..... 123/456, 123/468, 469, 470

See application file for complete search history.

(56) References Cited

U.S. PATENT DOCUMENTS

| | | | | |
|---|---|---|---|---|
| 2,528,040 | A * | 10/1950 | Crouch | 228/154 |
| 4,202,484 | A * | 5/1980 | Peterson | 228/173.2 |
| 4,500,030 | A * | 2/1985 | Gerber et al. | 228/125 |
| 4,681,349 | A * | 7/1987 | Press et al. | 285/55 |
| 6,860,517 | B2 * | 3/2005 | Sanders | 285/133.11 |
| 2006/0054139 | A1 | 3/2006 | Yamamoto et al. | |

FOREIGN PATENT DOCUMENTS

| | | |
|---|---|---|
| DE | 10307530 | 7/2006 |
| EP | 0751336 | 1/1997 |
| EP | 1416151 | 5/2004 |
| JP | 10169527 | 6/1998 |
| WO | 0142643 | 6/2001 |

* cited by examiner

*Primary Examiner*—Thomas N Moulis
(74) *Attorney, Agent, or Firm*—Thomas N. Twomey

(57) ABSTRACT

A fuel distribution tube for a direct injection fuel rail assembly includes an elongate cylindrical conduit, a plurality of first scalloped features that receive fuel injector sockets formed in the conduit, and plurality of second scalloped features that receive mounting bosses formed in the conduit. The scalloped features are designed to closely match the outer radii of the injector sockets and the mounting bosses. The scalloped features provide necessary dimensional control to injector sockets and mounting bosses and fuel passage from the fuel distribution tube to the fuel injector sockets. The scalloped features enable a leak test of the braze joints of the fuel rail assembly. By providing a direct injection fuel rail assembly that includes the fuel distribution tube having scalloped features formed in the conduit, optimization of true position location of fuel injector sockets and improved braze joints are enabled.

21 Claims, 3 Drawing Sheets

FUEL DISTRIBUTION TUBE FOR DIRECT INJECTION FUEL RAIL ASSEMBLIES

TECHNICAL FIELD

The present invention relates to fuel rail assemblies for supplying fuel to fuel injectors of internal combustion engines; more particularly, to fuel rail assemblies for supplying fuel for direct injection of gasoline (DIG) or of diesel fuel (DID) into engine cylinders; and most particularly, to an improved fuel distribution tube for direct injection fuel rail assemblies.

BACKGROUND OF THE INVENTION

Fuel rails for supplying fuel to fuel injectors of internal combustion engines are well known. A fuel rail assembly, also referred to herein simply as a fuel rail, is essentially an elongate tubular fuel manifold connected at an inlet end to a fuel supply system and having a plurality of ports for mating in any of various arrangements with a plurality of fuel injectors to be supplied. Typically, a fuel rail assembly includes a plurality of fuel injector sockets in communication with a manifold supply tube, the injectors being inserted into the sockets and held in place in an engine head by bolts securing the fuel rail assembly to the head.

Gasoline fuel injection arrangements may be divided generally into multi-port fuel injection (MPFI), wherein fuel is injected into a runner of an air intake manifold ahead of a cylinder intake valve, and direct injection gasoline (DIG), wherein fuel is injected directly into the combustion chamber of an engine cylinder, typically during or at the end of the compression stroke of the piston. DIG is designed to allow greater control and precision of the fuel charge to the combustion chamber, resulting in better fuel economy and lower emissions. This is accomplished by enabling combustion of an ultra-lean mixture under many operating conditions. DIG is also designed to allow higher compression ratios, delivering higher performance with lower fuel consumption compared to other fuel injection systems. Diesel fuel injection (DID) is also a direct injection type.

For purpose of clarity and brevity, wherever DIG is used herein it should be taken to mean that both DIG and DID, and fuel rail assemblies in accordance with the invention as described below are useful in both DIG and DID engines.

A DIG fuel rail must sustain much higher fuel pressures than a MPFI fuel rail to assure proper injection of fuel into a cylinder having a compressed charge during the compression stroke. DIG fuel rails may be pressurized to about 100 atmospheres or more, for example, whereas MPFI fuel rails must sustain pressures of only about 4 atmospheres. Error proof braze joints are, therefore, necessary for the assembly of fuel rails.

DIG fuel rails further require high precision in the placement of the injector sockets in the fuel supply tube because the spacing and orientation of the sockets along the fuel rail assembly must exactly match the three-dimensional spacing and orientation of the fuel injectors as installed in cylinder ports in the engine. For example, direct injection fuel rail assemblies typically require injector socket to injector socket true positions of less than about 0.5 mm. Braze joints typically require gaps less than 0.05 mm to approach base metal strength. When utilizing the brazing process for producing direct injection fuel rail assemblies both of these requirements must be met. Typical multi-port fuel rail fabrication components and techniques do not meet these requirements making it necessary to find alternate methods.

For example, matched radii with a braze joint have been suggested, where a radius is added to the injector socket to match the radius of the fuel supply tube. This concept requires features to be added to injector sockets and mounting bosses and further requires the use of drawn over mandrel tubing or tubing with improved straightness, which is expensive, labor and cycle time intensive. Accordingly, efforts to form satisfactory DIG fuel rail assemblies by metal forming and welding have not heretofore been successful.

What is needed in the art is an inexpensive, high-precision fuel rail assembly for DIG engine fuel systems.

It is a principal object of the present invention to provide a fuel distribution tube that enables optimization of the true position location of injector sockets as well as improved braze joints.

It is a further object of the invention to enable the use of inexpensive parts and welding methods.

SUMMARY OF THE INVENTION

Briefly described, a fuel distribution tube of a direct injection fuel rail assembly includes a plurality of machined scalloped features for receiving a plurality of fuel injector sockets and a plurality of mounting bosses. The scalloped features are designed to closely match the outer radii of the injector sockets and the mounting bosses. The scalloped features provide necessary dimensional control and fuel passage from the fuel distribution tube to the fuel injector sockets. The current need to drill or punch holes into the fuel distribution tube for fuel passage is eliminated in accordance with the present invention due to the formation of a hole when a scalloped feature is formed, for example, by cutting in the fuel distribution tube. A machining process may be used to form all scalloped features into the fuel distribution tube concurrently along a preset tooling centerline. This process allows the use of a mill quality fuel supply tube that is held on the tooling centerline. An ultimate centerline of the scalloped features is the result of the machine head position and tooling tolerances.

Incorporating the scalloped features into the fuel distribution tube enables the use of inexpensive mill quality tubing with standard tolerances for the fuel distribution tube, as well as the use of screw machine injector sockets and screw machine mounting bosses.

When the scalloped features are utilized for the bonding of the injector sockets and mounting bosses to the fuel distribution tube, in accordance with one embodiment of the invention, "no braze" conditions between the mounting boss and the fuel distribution tube can be detected after a brazing process by a leak test. During the leak test, the brazed joint would leak if it failed to properly fill. The leak test may replace a less reliable visual inspection as currently done after brazing. The leak test may also be applied to test the brazed joints between the injector sockets and the fuel distribution tube. Consequently, incorporating scalloped features into a fuel supply tube enables optimization of true position location and braze joint during a welding operation.

BRIEF DESCRIPTION OF THE DRAWINGS

The present invention will now be described, by way of example, with reference to the accompanying drawings, in which.

Corresponding reference characters indicate corresponding parts throughout the several views. The exemplification set out herein illustrates one preferred embodiment of the invention, in one form, and such exemplification is not to be construed as limiting the scope of the invention in any manner.

DESCRIPTION OF THE PREFERRED EMBODIMENTS

Figure 1:
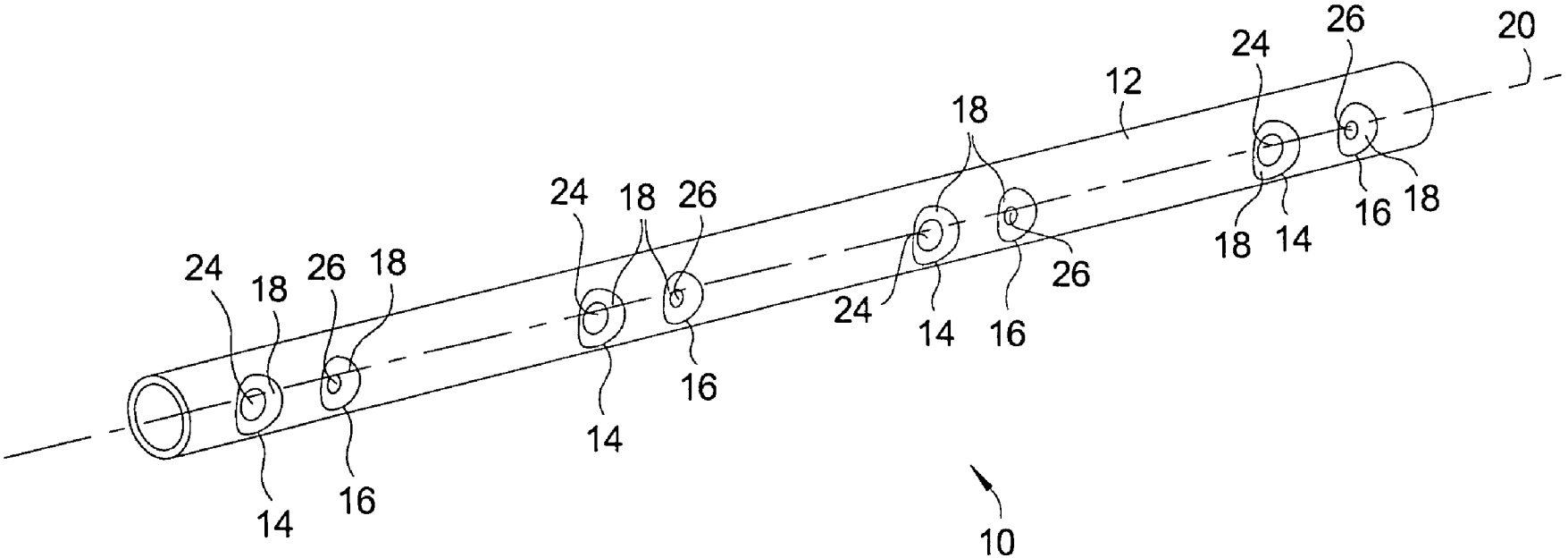
FIG. 1 is an isometric view of a fuel distribution tube, in accordance with the invention.
Figure 2:
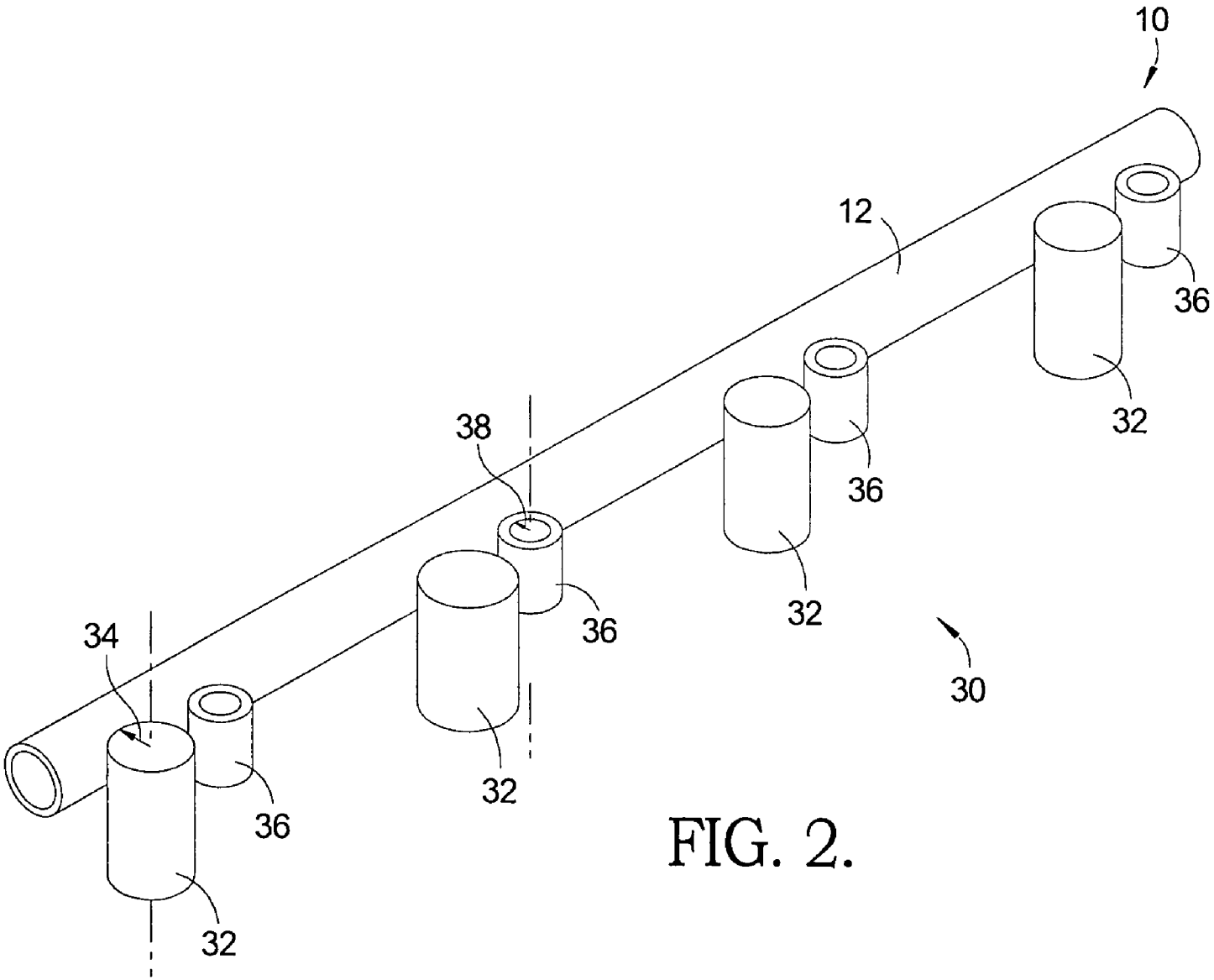
FIG. 2 is an isometric view of a direct injection fuel rail assembly, in accordance with the invention.

Referring to FIGS. 1 and 2, a fuel distribution tube 10 includes an elongate cylindrical conduit 12 having a plurality of scalloped features 14 and 16 incorporated. Fuel distribution tube 10 may be part of a direct injection fuel rail assembly of an internal combustion engine, such as assembly 30 shown in FIG. 2. Fuel distribution tube 10 may be connected to a fuel supply (not shown) at one end and may include a cap (not shown) at an opposite end.

Scalloped features 14 are designed to receive fuel injector sockets 32. Each scalloped feature 14 may be machined, for example, cut into conduit 12 to closely match a radius 34 of fuel injector sockets 32. Scalloped features 16 are designed to receive mounting bosses 36. Each scalloped feature 16 may be machined, for example, cut into conduit 12 to closely match a radius 38 of mounting bosses 36. While scalloped features 14 and 16 as well as fuel injector sockets 32 and mounting bosses 36 are shown in FIGS. 1 and 2, respectively, to be grouped as pairs and, therefore positioned proximate to each other, other arrangements along conduit 12 may be possible. Fuel injector sockets 32 and mounting bosses 36 may be relatively simple screw machine parts or parts simply formed by other means known in the art.

Each of the scalloped features 14 and 16 includes a faying surface 18 for mating with an outer circumference of injector sockets 32 and mounting bosses 36, respectively. Faying surface 18 of scalloped feature 16 may be larger than faying surface 18 of scalloped feature 14. Faying surfaces 18 are designed to provide a surface large enough for brazing. Scalloped features 14 and 16 provide necessary dimensional control for the temporary preassembly and the permanent assembly of fuel injector sockets 32 and mounting bosses to fuel distribution tube 10.

Scalloped features 14 and 16 incorporated in conduit 12 support temporary assembly methods for securing injector sockets 32 and mounting bosses 26 to conduit 12 prior to a brazing process that permanently joins injector sockets 32 and mounting bosses 36 with conduit 12 by applying heat and adding a filler material. Temporary assembly methods may include, for example, welding processes, such as tungsten inert gas welding, metal inert gas welding, and laser tack welding. If a resistance welding process, such as projection welding, is used as a temporary assembly method, fuel injector sockets 32 and mounting bosses 36 or conduit 12 may include projections (not shown) that are consumed during the injection welding process.

There is no need to drill or punch holes in conduit 12 for fuel passage as done in the known prior art, since a hole 24 or 26 is formed in the center of each scalloped feature 14 and 16 when scalloped feature 14 or 16, respectively, is formed in conduit 12. Each hole 24 and 26 is surrounded by a faying surface 18. Holes 24 and 26 provide fluid communication with interior of conduit 12. Accordingly, each scalloped feature 14 is a port for fuel passage. Each hole 24 and 26 is surrounded by faying surface 18. The diameter of holes 24 may be adjusted according to the desired fuel flow. Hole 24 may have a larger diameter than hole 26, since hole 24 is used as fuel passage, while hole 26 is only used for leak testing fuel rail assembly 30 after brazing. A leak test after brazing enables to detect "no braze" conditions between each mounting boss 36 and conduit 12 and between each injector socket 32 and conduit 12 because a joint would leak if the joint failed to properly fill during brazing. Such a leak test may be more reliable than a prior art visual inspection.

Since forming of scalloped features 13 and 16 into conduit 12 includes formation of holes 24 and 26, respectively, a mill quality conduit 12 that is held on a tooling centerline 20 and a multi tooled machining head to put all scalloped features 14 and 16 concurrently in along the preset tooling centerline 20 may be used. An ultimate centerline 20 of scalloped features 14 and 16 is the result of tooling machine head position and tooling tolerances and does not depend on the straightness of conduit 12.

Figure 3:
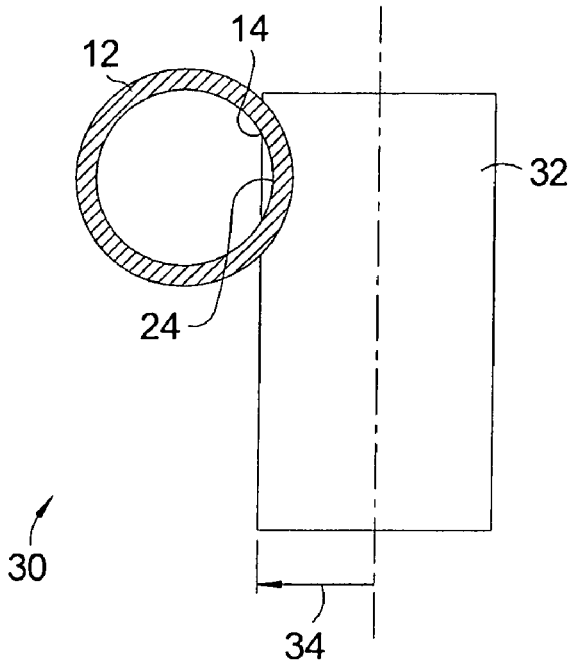
FIG. 3 is a cross-sectional view of the direct injection fuel rail assembly taken in front of an injector socket, in accordance with the invention.
Figure 4:
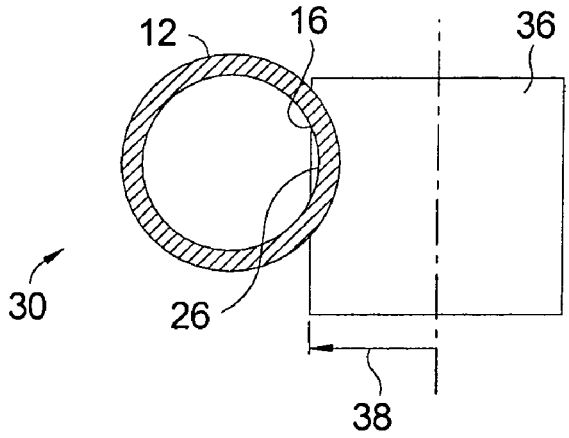
FIG. 4 is a cross-sectional view of the direct injection fuel rail assembly taken in front of a mounting boss, in accordance with the invention.

Referring to FIGS. 3 and 4, cross-sectional views of direct injection fuel rail assembly 30 taken in front of a fuel injector socket 32 and a mounting boss 36, respectively, are illustrated. As can be seen, scalloped features 14 and 16 formed in conduit 12 provide due to relatively large faying surfaces 18 braze joints that will yield a relatively high degree of serviceability under concentrated stress, vibration, and temperature loads.

By providing direct injection fuel rail assembly 30 that includes fuel distribution tube 10 having scalloped features 14 and 16 formed in conduit 12, optimization of true position location of fuel injector sockets 32 and improved braze joints are enabled.

While injector sockets 32 and mounting bosses 36 are shown paired together, other arrangements may be possible.

While four fuel injector sockets 32 and four mounting bosses 36 are shown, more or less injector sockets 32 and mounting bosses 36 may be assembled to fuel distribution tube 10.

While the invention has been described by reference to various specific embodiments, it should be understood that numerous changes may be made within the spirit and scope of the inventive concepts described. Accordingly, it is intended that the invention not be limited to the described embodiments, but will have full scope defined by the language of the following claims.

What is claimed is:

1. A fuel distribution tube for a direct injection fuel rail assembly, comprising:

an elongate cylindrical conduit;

a plurality of first scalloped features formed in said conduit, each of said first scalloped features including a first faying surface surrounding a first hole; and a plurality of second scalloped features formed in said conduit, each of said second scalloped features including a second faying surface surrounding a second hole.

2. The fuel distribution tube of claim 1, wherein each of said first scalloped features receives a fuel injector socket and closely matches a radius of said fuel injector socket.

3. The fuel distribution tube of claim 1, wherein each of said second scalloped features receives a mounting boss and closely matches a radius of said mounting boss.

4. The fuel distribution tube of claim 1, wherein said first and said second hole provide fluid communication with an interior of said conduit.

5. The fuel distribution tube of claim 1, wherein a diameter of said first hole of said first scalloped feature is larger than a diameter of said second hole of said second scalloped feature.

6. The fuel distribution tube of claim 1, wherein said first and said second hole enable a leak test of braze joints between said conduit and injector sockets and between said conduit and mounting bosses.

7. The fuel distribution tube of claim 1, wherein said first faying surface assists mating of said conduit with an outer circumference of an injector socket, and wherein said second faying surface assists mating of said conduit with an outer circumference of a mounting boss.

8. The fuel distribution tube of claim 1, wherein said first and said second faying surface provides a surface for brazing.

9. The fuel distribution tube of claim 1, wherein one of said first scalloped features is positioned proximate to one of said second scalloped features.

10. The fuel distribution tube of claim 1, wherein formation of said first and said second scalloped features in said conduit includes formation of said first and said second hole positioned in a center of each of said first and said second scalloped features, respectively.

11. A direct injection fuel rail assembly of an internal combustion engine, comprising:

a fuel distribution tube including a first scalloped feature and a second scalloped feature;

a fuel injector socket assembled to said fuel distribution tube, wherein said first scalloped feature receives said fuel injector socket, and wherein said first scalloped feature closely matches a radius of said fuel injector socket; and a mounting boss assembled to said fuel distribution tube, wherein said second scalloped feature receives said mounting boss, and wherein said second scalloped feature closely matches a radius of said mounting boss.

12. The fuel rail assembly of claim 11, further including at least one additional first scalloped feature receiving an additional fuel injector socket and at least one additional second scalloped feature receiving an additional mounting boss.

13. The fuel rail assembly of claim 11, wherein said first scalloped feature and said second scalloped feature include a faying surface surrounding a center hole, wherein said faying surface is a brazing surface, and wherein said center hole provides fluid communication with an interior of said fuel distribution tube.

14. The fuel rail assembly of claim 11, wherein said first and said second scalloped feature are formed concurrently along a tooling centerline.

15. The fuel rail assembly of claim 11, wherein said fuel distribution tube is a mill quality conduit.

16. The fuel rail assembly of claim 11, wherein said fuel injector socket and said mounting boss are screw machine parts.

17. The fuel rail assembly of claim 11, wherein said first scalloped feature and said second scalloped feature support temporary assembly methods for securing said fuel injector socket and said mounting boss to said conduit prior to a brazing process that permanently joins said injector socket and said mounting boss with said conduit.

18. A method for assembling a direct injection fuel rail, comprising the steps of:

forming a plurality of first scalloped features in a fuel distribution tube to closely match a radius of fuel injector sockets;

forming a plurality of second scalloped features in said fuel distribution tube to closely match a radius of mounting bosses; and forming holes in a center of said first and said second scalloped features concurrently said first and second features to provide fluid communication to an interior of said fuel distribution tube.

19. The method of claim 18, further including the steps of:

temporarily assembling said fuel injector socket and said mounting bosses to said fuel distribution tube via said first and said second scalloped features, respectively;

permanently assembling said fuel injector socket and said mounting bosses to said fuel distribution tube via said first and said second scalloped features, respectively, by forming a braze joint; and leak testing said braze joint utilizing said holes.

20. The method of claim 18, further including the steps of:

using a mill quality conduit for said fuel distribution tube; and machining said first and said second scalloped features in said conduit concurrently along a tooling centerline using a multi tooled machining head.

21. A fuel distribution tube for a direct injection fuel rail assembly, comprising:

an elongate cylindrical conduit;

a plurality of scalloped features formed in said conduit, each of said plurality of scalloped features including a faying surface surrounding a hole.

* * * * *